US009738994B2

(12) United States Patent
Ikeda et al.

(10) Patent No.: US 9,738,994 B2
(45) Date of Patent: Aug. 22, 2017

(54) CARBON FIBER PRECURSOR ACRYLIC FIBER BUNDLE, METHOD FOR THERMALLY OXIDIZING PART THEREOF, THERMAL OXIDATION OVEN, AND PROCESS FOR PRODUCING CARBON FIBER BUNDLE

(71) Applicant: Mitsubishi Chemical Corporation, Chiyoda-ku (JP)

(72) Inventors: Tadanobu Ikeda, Otake (JP); Tadao Samejima, Toyohashi (JP); Youji Hatanaka, Otake (JP); Tetsu Yasunami, Toyohashi (JP)

(73) Assignee: Mitsubishi Chemical Corporation, Tokyo (JP)

( * ) Notice: Subject to any disclaimer, the term of this patent is extended or adjusted under 35 U.S.C. 154(b) by 0 days.

(21) Appl. No.: 14/391,802

(22) PCT Filed: Apr. 12, 2013

(86) PCT No.: PCT/JP2013/061048

§ 371 (c)(1),
(2) Date: Oct. 10, 2014

(87) PCT Pub. No.: WO2013/154178

PCT Pub. Date: Oct. 17, 2013

(65) Prior Publication Data

US 2015/0110705 A1 Apr. 23, 2015

(30) Foreign Application Priority Data

Apr. 12, 2012 (JP) ..... 2012-090877

(51) Int. Cl.
*D01F 9/21* (2006.01)
*D01F 9/22* (2006.01)
(Continued)

(52) U.S. Cl.
CPC ..... *D01F 9/21* (2013.01); *B65H 69/063* (2013.01); *D01F 6/18* (2013.01); *D01F 9/22* (2013.01);
(Continued)

(58) Field of Classification Search
CPC ..... D01F 6/18; D01F 9/21; D01F 9/22; D01F 9/225; D10B 2101/12; B65H 69/063; B65H 2515/12; B65H 2701/314
See application file for complete search history.

(56) References Cited

U.S. PATENT DOCUMENTS 4,466,949 A 8/1984 Mori
4,609,540 A * 9/1986 Izumi ..... D01F 9/32 264/29.2
(Continued)

FOREIGN PATENT DOCUMENTS

EP 0 426 858 A1 5/1991
EP 1 420 091 A1 5/2004
(Continued)

OTHER PUBLICATIONS

Extended European Search Report issued Feb. 5, 2016 in Patent Application No. 13776386.8.
(Continued)

*Primary Examiner* — Scott R Walshon
(74) *Attorney, Agent, or Firm* — Oblon, McClelland, Maier & Neustadt, L.L.P.

(57) ABSTRACT

A carbon-fiber-precursor acrylic fiber bundle which can smoothly pass through a flame-resistance impartation step and a carbonization step. The carbon-fiber-precursor acrylic fiber bundle has a high-density part as a portion thereof, wherein the high-density part satisfies the following requirements (A) and (B). Requirement A: The high-density part has a maximum fiber density $\rho_{max}$ of 1.33 g/cm$^3$ or higher.
(Continued)

Requirement B: The portion extending between an intermediate-density point and a maximum-density-region arrival point has an increase in fiber density of $1.3\times10^{-2}$ g/cm$^3$ or less per 10 mm of the fiber bundle length.

14 Claims, 3 Drawing Sheets

(51) Int. Cl.

| | |
|---|---|
| ***F27D 7/04*** | (2006.01) |
| ***F27D 7/06*** | (2006.01) |
| ***D01F 9/32*** | (2006.01) |
| ***D01F 6/18*** | (2006.01) |
| ***B65H 69/06*** | (2006.01) |
| ***D04H 3/007*** | (2012.01) |
| ***D04H 3/04*** | (2012.01) |
| ***F27B 17/00*** | (2006.01) |

(52) U.S. Cl.
CPC ..... *D01F 9/225* (2013.01); *D01F 9/328* (2013.01); *D04H 3/007* (2013.01); *D04H 3/04* (2013.01); *F27B 17/0016* (2013.01); *F27D 7/04* (2013.01); *F27D 7/06* (2013.01); *D10B 2101/12* (2013.01); *F27D 2007/063* (2013.01)

(56) References Cited

U.S. PATENT DOCUMENTS

| | | | | |
|---|---|---|---|---|
| 4,780,301 | A * | 10/1988 | Nakatani | D01F 9/32 423/447.4 |
| 5,142,796 | A | 9/1992 | Anzai et al. | |
| 2005/0115103 | A1 | 6/2005 | Yamaguchi et al. | |
| 2012/0137638 | A1 | 6/2012 | Ikeda et al. | |

FOREIGN PATENT DOCUMENTS

| | | |
|---|---|---|
| EP | 2 348 143 A1 | 7/2011 |
| JP | 56-37315 | 4/1981 |
| JP | 2000-144534 | 5/2000 |
| JP | 2008-150733 | 7/2008 |
| JP | 2008-190068 | 8/2008 |
| WO | 2011/019002 A1 | 2/2011 |

OTHER PUBLICATIONS

Extended European Search Report issued Sep. 8, 2015 in Patent Application No. 13776386.8.

* cited by examiner

[Fig. 1]
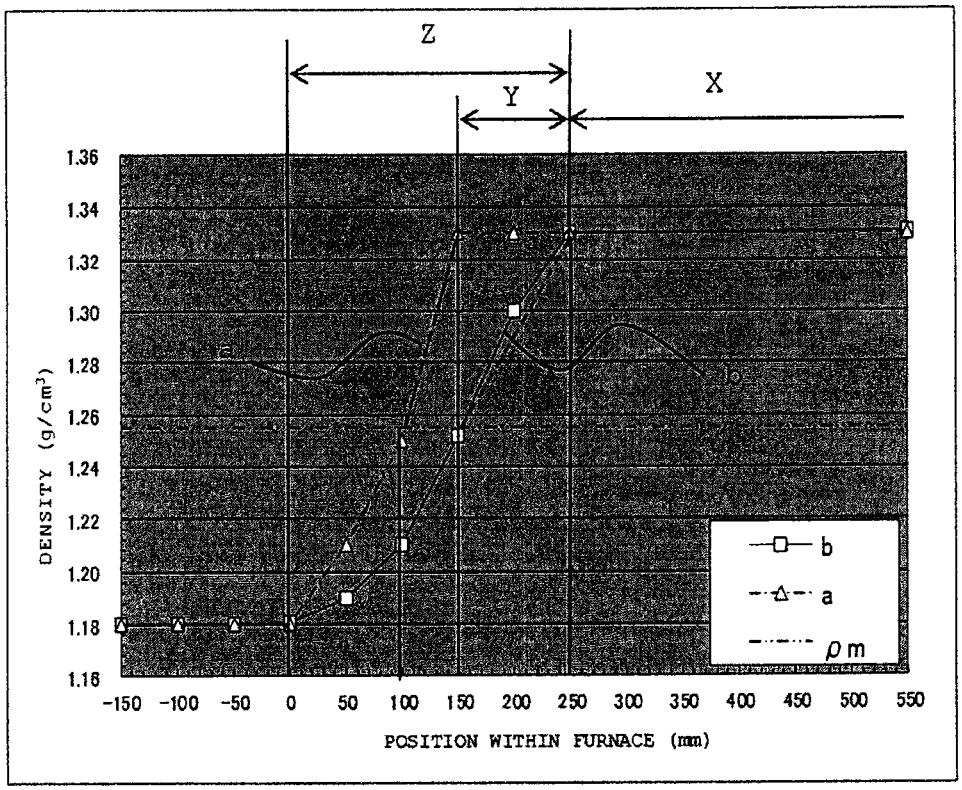
[FIG. 2]
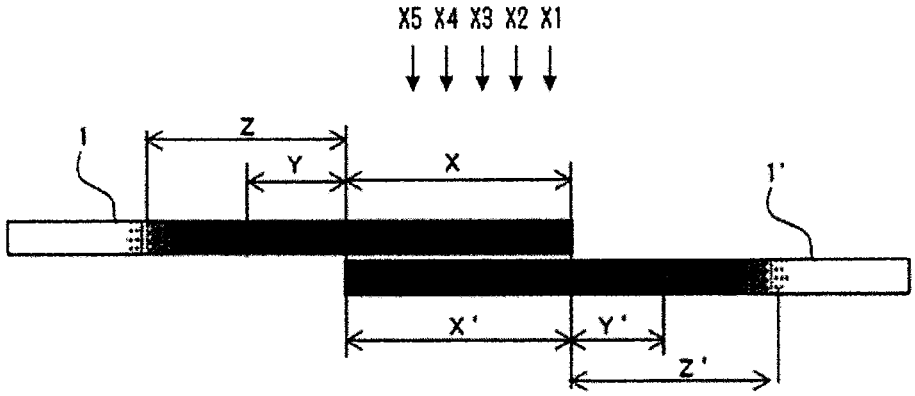

[FIG. 3]
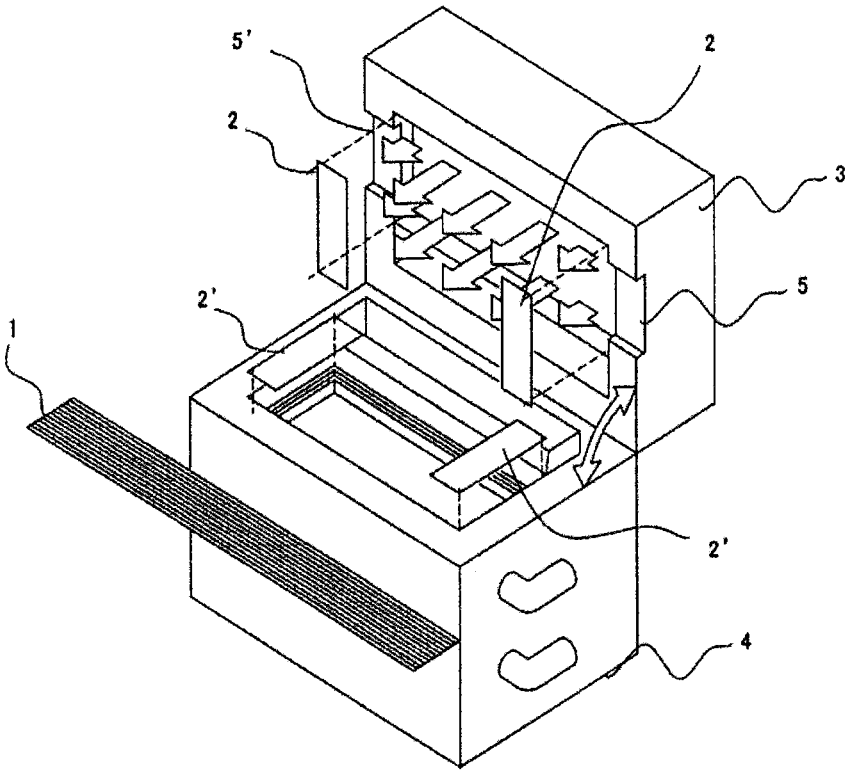
[FIG. 4]
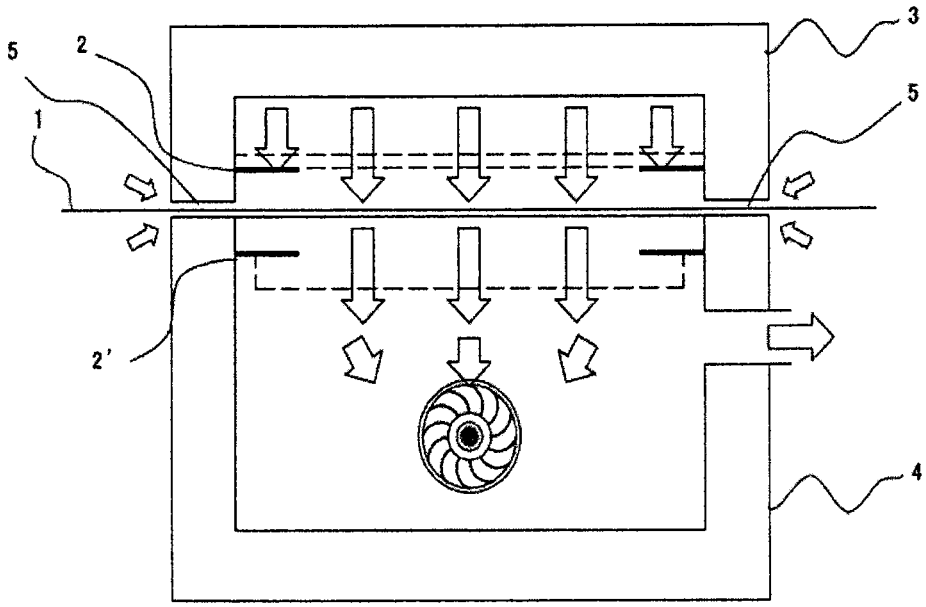

[FIG. 5]
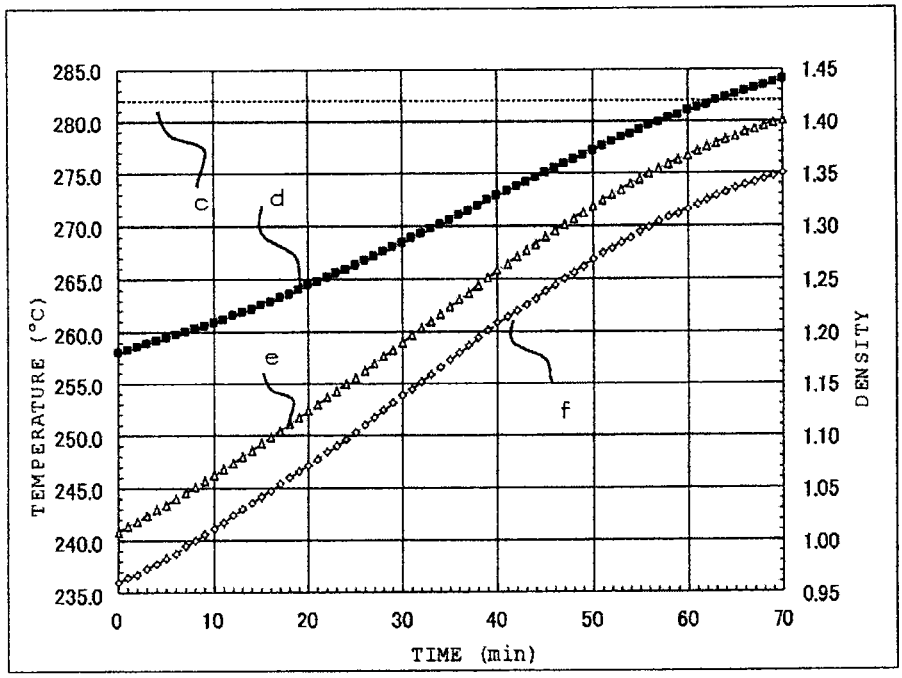

CARBON FIBER PRECURSOR ACRYLIC FIBER BUNDLE, METHOD FOR THERMALLY OXIDIZING PART THEREOF, THERMAL OXIDATION OVEN, AND PROCESS FOR PRODUCING CARBON FIBER BUNDLE

TECHNICAL FIELD

The present invention relates to a carbon fiber precursor acrylic fiber bundle having a high density part as a portion thereof, a thermal oxidation oven for obtaining the carbon fiber precursor acrylic fiber bundle, and a process for producing a carbon fiber bundle.

BACKGROUND ART

Conventionally, acrylic fiber bundle yarn has been widely used as a precursor for producing a carbon fiber bundle. As a process for producing a carbon fiber bundle, a method of obtaining a carbon fiber bundle by a flame resistance impartation step for a heating treatment of acrylic fiber bindle yarn in an oxidizing atmosphere of 200 to 300° C. to give a flame resistant fiber bundle and subsequently by a carbonization step for a heating treatment in an inert atmosphere of 1000° C. or higher is known.

The carbon fiber bundle obtained as above has various favorable physical properties, and thus it is widely used as a reinforcement fiber of various fiber-reinforced composite material and the like. In addition to the conventional use for an airplane or a sports gear, the carbon fiber bundle is also used for an application in construction, civil engineering, or energy-related industry, and thus the demand is now sky-rocketing. In order to further broaden the demand, supplying the carbon fiber bundle at lower cost is desired.

In general, a precursor yarn such as an acrylic fiber bundle for producing a carbon fiber is supplied in bobbin-wound form or laminate form after being folded into a box shape. The precursor yarn in such storage form is supplied to various calcination steps such as a flame resistance impartation step or a carbonization step. In order to improve the workability during the calcination step to lower the production cost of a carbon fiber bundle, it is necessary to connect plural precursor yarns and supply them continuously to a calcination step during the production of a carbon fiber bundle in which the precursor yarn is supplied to a calcination step. For such reasons, a technique of connecting a rear end of a precursor yarn which is in the storage form described above to a tip of the following precursor yarn is known (Patent Documents 1 to 3).

Patent Document 2 suggests a method of using a yarn obtained by performing a flame resistance impartation treatment (thermal oxidization treatment) of a rear end of a precursor yarn, a tip of the following precursor yarn, or both ends, in order to prevent thread breaking, during calcination, that is caused by accumulated heat occurring at a connection part between yarns. Patent Document 1 suggests a method of using a yarn which is preliminarily subjected to a flame resistance impartation step when a rear end of a preceding precursor yarn and a tip of the following precursor yarn are connected. Patent Document 3 suggests a method of using a yarn which is preliminarily subjected to a thermal treatment and using a special knotting method.

CITATION LIST

Patent Document

Patent Document 1: JP 2000-144534 A
Patent Document 2: JP 2008-150733 A
Patent Document 3: JP 56-37315 A

SUMMARY OF INVENTION

Technical Problem

However, with the flame resistance impartation method for treating an end of a carbon fiber precursor acrylic fiber bundle described in Patent Document 1 or Patent Document 3, the density of the end imparted with flame resistance is as low as 1.30 g/cm$^3$. As such, during the flame resistance impartation step, the connection part between fiber bundles may easily have heat generation due to an oxidation reaction. Further, due to high thickness, heat may be easily accumulated. Therefore, the fiber bundle cannot smoothly pass through a flame resistance impartation step, which has a high heating temperature and high process tension. Further, although the flame resistance impartation treatment of an end of a carbon fiber precursor acrylic fiber bundle is performed at a high temperature of 250° C. and in short time of 47 minutes in Example 1 of Patent Document 2, it corresponds to the temperature right before breaking of a fiber bundle caused by heating. As such, a safe and stable flame resistance impartation treatment cannot be performed.

For such reasons, in order for the connection part of an acrylic fiber bundle to smoothly pass through both of the flame resistance impartation step and the carbonization step in the method described in the above patent documents, it is necessary to lower the elongation rate of the acrylic fiber bundle during both of the flame resistance impartation step with a high heating temperature and high process tension and also the carbonization step with high process tension. In contrast, when conditions for the heating temperature and process tension in both of the steps are loosened, it is difficult to achieve high speed production of a carbon fiber bundle.

An object of the present invention is to provide a carbon fiber precursor acrylic fiber bundle having a connection part between fiber bundles which smoothly passes through both a flame resistance impartation step with a high heating temperature and high process tension and also a carbonization step with high process tension. There are also provided a thermal oxidization furnace and a method for thermal oxidization treatment enabling forming of, within a short time, a high density part according to a thermal oxidation treatment of an end in the longitudinal direction of a carbon fiber precursor acrylic fiber bundle.

Solution to Problem

The aforementioned problems are solved by the following [1] to [16] of the present invention.

[1] A carbon fiber precursor acrylic fiber bundle having a high density part as a portion thereof, in which the high density part satisfies the following Requirements A and B;

Requirement A: The high density part has a maximum fiber density $\rho_{max}$ of 1.33 g/cm$^3$ or higher.

Requirement B: The increase in fiber density between an intermediate density point and a maximum density region arrival point is $1.3\times10^{-2}$ g/cm$^3$ or less per 10 mm of a fiber bundle length.

With the proviso that, the term "intermediate density point" means the site which has a density $\rho_m$ $(=(\rho_0+\rho_{max})/2)$ that is intermediate between the fiber density $\rho_0$ of a non-high density part and the maximum fiber density $\rho_{max}$. The term "maximum density region arrival point" means the site $P_r$ at which the increase in fiber density per 10 mm of the fiber bundle length becomes $1.0\times10^{-3}$ g/cm$^3$ or less, the increase in fiber density being represented by $(\rho_{r+1}-\rho_r)/5$ determined from a measurement in which density measurement points beginning with the density increase start point and located at intervals of 50 mm ($P_1$, $P_2$, . . . , $P_r$, $P_{r+1}$, . . . , $P_n$) are successively examined for fiber density ($\rho_1$, $\rho_2$, . . . , $\rho_r$, . . . , $\rho_n$). The term "density increase start point" means a site at which the fiber density is higher by 0.01 g/cm$^3$ than the fiber density $\rho_0$ of the non-high density part.

[2] The carbon fiber precursor acrylic fiber bundle described in the above [1], in which the high density part further satisfies the following Requirement C; Requirement C: The fiber density monotonously increases from the density increase start point to the maximum density region arrival point.

[3] The carbon fiber precursor acrylic fiber bundle described in the above [1] or [2], in which the high density part further satisfies the following Requirement D; Requirement D: The increase in fiber density per 10 mm of the fiber bundle length is $2.0\times10^{-2}$ g/cm$^3$ or less from the density increase start point to the intermediate density point.

[4] The carbon fiber precursor acrylic fiber bundle described in the above [1] or [2], in which the high density part further satisfies the following Requirement E; Requirement E: The length of the part in which the fiber density is 1.33 g/cm$^3$ or higher is 50 mm or longer.

[5] The carbon fiber precursor acrylic fiber bundle described in the above [1] or [2], in which the high density part further satisfies the following Requirement F; Requirement F: The length from the density increase start point to the maximum density arrival point is 150 mm or longer.

[6] A thermal oxidation oven for partially heating a carbon fiber precursor acrylic fiber bundle and obtaining a carbon fiber precursor acrylic fiber bundle having a high density part as a portion thereof, the thermal oxidation oven having at least one opening and a high temperature heating part and at least one low temperature heating part at a position corresponding to the longitudinal direction of the carbon fiber precursor acrylic fiber bundle to be heated in which at least one of the low temperature heating part is arranged near the opening.

[7] The thermal oxidation oven described in the above [6], in which it has a means for spraying hot wind to a carbon fiber precursor acrylic fiber bundle and a wind-blocking plate for blocking the hot wind with the low temperature heating part being formed by the wind-blocking plate.

[8] A process for producing a carbon fiber precursor acrylic fiber bundle which has a high density part as a portion thereof, satisfying the following Requirement (1) to Requirement (4);

Requirement (1): A part of the carbon fiber precursor acrylic fiber bundle is arranged inside a thermal oxidation oven having at least one opening and the remaining part of the carbon fiber precursor acrylic fiber bundle is arranged outside the thermal oxidation oven.

Requirement (2): The carbon fiber precursor acrylic fiber bundle arranged inside the thermal oxidation oven is heated, at a position corresponding to the longitudinal direction thereof, with hot wind at a high temperature and hot wind at a low temperature, in which the carbon fiber precursor acrylic fiber bundle present near at least one opening is heated by the hot wind at a low temperature.

Requirement (3): As for the temperature of the hot wind at a high temperature, the maximum temperature from the start to the end of heating is at least in the temperature range of 200° C. to 300° C.

Requirement (4): Heating is performed until the maximum fiber density $\rho_{max}$ of the high density part of the carbon fiber precursor acrylic fiber bundle reaches 1.33 g/cm$^3$ or higher.

[9] The process for producing a carbon fiber precursor acrylic fiber bundle described in the above [8], further satisfying the following Requirement (5);

Requirement (5): The heating temperature T for the high temperature heating part is raised to a temperature which is 3 to 5° C. lower than an upper limit temperature Tmax of a carbon fiber precursor acrylic fiber bundle to be heated at that heating time point.

[10] The process for producing a carbon fiber precursor acrylic fiber bundle described in the above [8], in which the thermal oxidation oven has a means for spraying hot wind to a carbon fiber precursor acrylic fiber bundle and a wind-blocking plate for blocking the hot wind and hot wind at a low temperature is formed by the wind-blocking plate.

[11] The carbon fiber precursor acrylic fiber bundle described in the above [1] obtained by the producing process described in any one of the above [8] to [10].

[12] A process for producing a carbon fiber bundle having the following Step (1) to Step (3);

(1) Step for connecting an end of the high density part of the carbon fiber precursor acrylic fiber bundle described in any one of above 1 to 5 having a high density part at an end thereof (a portion with length L) to the end of a high density part of another similar carbon fiber precursor acrylic fiber bundle (a portion with length L).

(2) Step for performing a flame resistance treatment by heating the connected carbon fiber precursor acrylic fiber bundle in an oxidizing atmosphere and in the temperature range of 200 to 300° C., and (3) Step for performing a carbonization treatment by heating the obtained flame resistant fiber bundle in an inert atmosphere and in the temperature range of 1000° C. or higher.

[13] The process for producing a carbon fiber bundle described in the above [12], in which Step (1) is a step for an entanglement treatment of the end part of a high density part of a fiber bundle (a portion with length L) by using high pressure fluid.

[14] The process for producing a carbon fiber bundle described in the above [12], in which Step (1) is a step for an entanglement treatment of the end part of a high density part of a fiber bundle (a portion with length L) at three or more but six or less points in the length direction.

[15] The process for producing a carbon fiber bundle described in the above [13], in which pressure for ejecting the high pressure fluid from a nozzle is 0.5 to 1 MPa.

[16] The process for producing a carbon fiber bundle described in the above [14], in which Step (1) described above is a step for performing an entanglement treatment on a tip which is not subjected to an entanglement treatment (a portion with length Lt) by using high pressure fluid after performing an entanglement treatment of the end of a high density part of a fiber bundle (a portion with length L) at three or more but six or less points in the length direction, and embedding the tip in a connection part of the fiber bundle.

With the proviso that, the term "upper limit temperature Tmax" in the invention of above [9] is a temperature defined by a fiber bundle as a subject for a thermal oxidation treatment and a thermal oxidation oven used for a thermal oxidation treatment and is a temperature which is 1° C. lower than the "temperature Tb for yielding a break by heating", which is measured according to the following conditions. Tmax=Tb−1(° C.)

Method for measuring "temperature Tb for yielding a break by heating":

(1) A fiber bundle corresponding to processing capacity of a thermal oxidation oven is prepared (for a furnace with n pendulums, an amount corresponding to n pendulums). The thermal oxidation oven (furnace length: Lo) is heated and maintained at a set temperature which is 4° C. lower than the expected Tb value of the fiber bundle.

(2) By using a means for holding a fiber bundle having a fixing part and a load application part, the end of the fiber bundle is arranged horizontally such that a distance Lw between the fixing part and the load application part is longer than the furnace length Lo. A pendulum of 4 kg is placed on the load application part which is present at the outermost end of the fiber bundle and tension is applied to the fiber bundle.

(3) The fiber bundle is introduced into a thermal oxidation oven and subjected to a heat treatment for 10 minutes.

(4) When there is no abnormality such as break in the fiber bundle after the heat treatment for 10 minutes, the thermal oxidation oven is heated by raising the set temperature by 2° C. followed by maintaining, and subsequently the above operations (2) and (3) are newly performed.

(5) The above operation (4) is repeated until there is an abnormality such as break in the fiber bundle.

(6) When there is an abnormality such as break in the fiber, the thermal oxidation oven is heated to a set temperature which is 1° C. lower than the set temperature at which the abnormality occurs followed by maintaining, and subsequently the above operations (2) and (3) are newly performed.

(7) When there is an abnormality such as break during the operation of above (6), the set temperature of the above (6) is determined as the temperature Tb for yielding a break by heating. On the other hand, when there is no abnormality such as break during the operation of above (6), the temperature which is 1° C. higher than the set temperature of above (6) is determined as the temperature Tb for yielding a break by heating.

Advantageous Effects of Invention

The carbon fiber precursor acrylic fiber bundle having a high density part as a portion thereof of the present invention can smoothly pass through both a flame resistance impartation step and a carbonization step. Further, with the process for producing a carbon fiber precursor acrylic fiber bundle and the thermal oxidation oven of the present invention, a high density part can be formed by a short-time thermal oxidation treatment of a part of the carbon fiber precursor acrylic fiber bundle.

BRIEF DESCRIPTION OF DRAWINGS

FIG. 1 is a drawing illustrating the distribution state of the fiber density at an end of a carbon fiber precursor acrylic fiber bundle;

FIG. 2 is a drawing illustrating an overlapping state of two ends when ends of two carbon fiber precursor acrylic fiber bundles of the present invention are connected to each other;

FIG. 3 is a schematic perspective view of the thermal oxidation oven of the present invention;

FIG. 4 is a schematic cross-sectional view of the thermal oxidation oven of the present invention; and FIG. 5 is a drawing illustrating an exemplary over-the-time change of an upper limit temperature Tmax for thermal oxidation treatment, heating temperature T, and expected density ρ during the production of the carbon fiber precursor acrylic fiber bundle of the present invention.

DESCRIPTION OF EMBODIMENTS

Hereinbelow, the embodiments of the present invention are explained in view of the drawings. Meanwhile, in the following explanations, various "lengths" with regard to a thermal oxidation oven mean the lengths corresponding to the longitudinal direction of a carbon fiber precursor acrylic fiber bundle. Further, the direction of a thermal oxidation oven corresponding to the longitudinal direction of the fiber bundle is referred to as hx direction of the thermal oxidation oven. Further, the term "inner length" means a distance in the horizontal direction (hy direction) which is perpendicular to the length direction. Location in the hx direction in a space within the thermal oxidation oven is represented by having two ends of the inner space of the thermal oxidation oven as reference position (0 mm) and by having the direction from the reference position to the center of the thermal oxidation oven as positive direction and the direction from the reference position to an outside of the thermal oxidation oven as a negative direction.

$\rho_{max}$ represents the "maximum fiber density" of a high density part. $\rho_0$ represents the "fiber density of a non-high density part", that is, fiber density of a carbon fiber precursor acrylic fiber bundle before a thermal oxidation treatment. $\rho_i$ represents the fiber density of a density increase start point. The "density increase start point" indicates a site having density that is 0.01 g/cm$^3$ higher than the fiber density $\rho_0$ of a non-high density part.

$\rho_m$ represents fiber density of an intermediate density point. The "intermediate density point" represents a site which has a density $\rho_m$ ($=0.5(\rho_0+\rho_{max})$) that is intermediate between the fiber density $\rho_o$ of the non-high density part and the maximum fiber density $\rho_{max}$.

The term "maximum density region arrival point" means the site $P_r$ at which the increase in fiber density per 10 mm of the fiber bundle length becomes $1.0\times10^{-3}$ g/cm$^3$ or less, the increase in fiber density being represented by $(\rho_{r+1}-\rho_r)/5$ determined from a measurement in which density measurement points beginning with the density increase start point and located at intervals of 50 mm ($P_1$, $P_2$, . . . , $P_r$, $P_{r+1}$, . . . , $P_n$) are successively examined for fiber density ($\rho_1$, $\rho_2$, . . . , $\rho_r$, . . . , $\rho_n$).

Meanwhile, the measurement of fiber density is performed for a fiber bundle which has a length of 40 mm having the density measurement point at the center.

<Carbon Fiber Precursor Acrylic Fiber Bundle>

The carbon fiber precursor acrylic fiber bundle of the present invention (hereinbelow, it may be also simply referred to as a "precursor fiber bundle") has a high density part as a portion thereof in which the high density part satisfies pre-determined requirements. The precursor fiber bundle can be produced by a thermal oxidation treatment of a known carbon fiber precursor acrylic fiber bundle.

FIG. 1 is a model diagram showing the density distribution in an end of a precursor fiber bundle. The line indicated by "a" represents fiber density distribution of a precursor fiber bundle which has been subjected to a thermal oxidation treatment without using the thermal oxidation oven of the present invention. The line indicated by "b" represents fiber density distribution of the precursor fiber bundle of the present invention which has been obtained by using the thermal oxidation oven of the present invention. X represents the maximum fiber density region. Y represents a portion from the intermediate density point to the maximum density region arrival point. Z represents a portion from the density increase start point to the maximum density region arrival point.

In the present invention, measurement of fiber density is performed for a test specimen with 40 mm length. The density measurement points (15 points) are positions located at intervals of 50 mm between the −150 mm position (first measurement point), which is in outside direction of a thermal oxidation oven from the reference point (0 mm) of a thermal oxidation oven, and the 550 mm position (fifteenth measurement point), which is in the direction toward the center of the furnace. The fiber bundle having entire length of 40 mm, that is, 20 mm on the right and left sides by having each of 15 density measurement points as selected above at the center, becomes a test specimen. Measurement of fiber density was performed according to JIS R7603: 1999 Carbon fiber—Method for determination of density (Method C: Density gradient tube method).

Vertical axis of FIG. 1 represents the fiber density and horizontal axis represents the position in length direction of a thermal oxidation oven. "0 mm" on the horizontal axis corresponds to the "reference position" described above, and it represents the position of an end which is in contact with an opening within the thermal oxidation oven. "−150 mm" represents the position of the outermost position of the thermal oxidation furnace. Further, it indicates that the length of the opening present between them is 150 mm. Further, the wind-blocking plate is installed on an inner side of the thermal oxidation oven from the 0 mm position.

The precursor fiber bundle of the present invention has a high density part as a portion thereof, and the high density part satisfies the following requirement A and requirement B.

[Requirement A]

According to the precursor fiber bundle of the present invention, the high density part has maximum fiber density $\rho_{max}$ of 1.33 g/cm$^3$ or higher. When precursor fiber bundles having a high density part at an end are connected to each other such that the end serves as a connection part and a series of the precursor fiber bundle obtained accordingly is subjected to a flame resistance impartation step and a carbonization step, breaking of the connection part caused by heat generation or heat accumulation during the flame resistance impartation step and/or carbonization step can be easily suppressed if the fiber density of the connection part is 1.33 g/cm$^3$ or higher. Although it is preferable to have higher fiber density, time and cost are needed to have high fiber density. For such reasons, it is sufficient that the maximum fiber density $\rho_{max}$ of the high density part is 1.33 g/cm$^3$.

[Requirement B]

According to the precursor fiber bundle of the present invention, the portion extending between an intermediate density point and a maximum density region arrival point has an increase in fiber density of $1.3\times10^{-2}$ g/cm$^3$ or less per 10 mm of the fiber bundle length. The portion extending between an intermediate density point and a maximum density region arrival point represents a region indicated by arrow Y in FIG. 1, for example, and it corresponds to a position between 150 mm and 250 mm in the furnace. When the value is $1.3\times10^{-2}$ g/cm$^3$ or less, it is easy to suppress breaking of a connection part during the flame resistance impartation step or the carbonization step. The value is preferably $1.1\times10^{-2}$ g/cm$^3$ or less.

[Requirement C]

It is preferable that the high density part of the precursor fiber bundle of the present invention further satisfy the following requirement C.

Requirement C: The fiber density monotonously increases from the density increase start point to the maximum density region arrival point.

As described herein, the expression "monotonously increases" means that the fiber density does not substantially decrease from the density increase start point, that is, a site at which the fiber density is higher by 0.01 g/cm$^3$ than a part of the precursor fiber bundle, which has not been subjected to the thermal oxidation treatment, with general density (non-high density part, in case of an acrylic fiber bundle containing acrylonitrile unit at 95% or more, 1.18 g/cm$^3$ or so), to the maximum density region arrival point. The precursor fiber bundle satisfying this requirement can pass smoothly both the flame resistance impartation step and the carbonization step.

[Requirement D]

It is preferable that the high density part of the precursor fiber bundle of the present invention further satisfy the following requirement D.

Requirement D: The increase in fiber density from the density increase start point to the intermediate density point is $2.0\times10^{-2}$ g/cm$^3$ or less per 10 mm of the fiber bundle length.

When this requirement is satisfied, it is easy to suppress breaking of a connection part during the flame resistance impartation step or the carbonization step. The value is more preferably $1.7\times10^{-2}$ g/cm$^3$ or less.

[Requirement E]

It is preferable that the high density part of the precursor fiber bundle of the present invention further satisfy the following requirement E.

Requirement E: The length of the part in which the fiber density is 1.33 g/cm$^3$ or higher is 50 mm or longer.

The length of the part in which the fiber density is 1.33 g/cm$^3$ or higher is the length of part X in FIG. 1, for example. In order to produce a connection part according an entanglement treatment of high density parts of a precursor fiber bundle, the length of the part X is preferably 50 mm or longer. More preferably, it is 100 mm or longer, and still more preferably 200 mm or longer. When the length of the part X is 50 mm or longer, it is easy to connect an end of a high density part of a precursor fiber bundle at one side to an end of a high density part of a precursor fiber bundle at the other side. It is also easy to connect them again when the connection is insufficient. Meanwhile, as the size of the thermal oxidation oven increases, it costs more for production. Further, it also leads to higher cost for heating as the internal volume of the thermal oxidation oven increases. As such, the length of the part X is preferably 700 mm or shorter, and more preferably 500 mm or shorter.

[Requirement F]

It is preferable that the high density part of the precursor fiber bundle of the present invention further satisfy the following requirement F.

Requirement F: The length from the density increase start point to the maximum density arrival point is 150 mm or longer.

The length from the density increase start point to the maximum density arrival point indicates the length of part Z in FIG. 1, for example. When the length is 150 mm or longer, it is easy to suppress a rapid increase in fiber density per 10 mm of the fiber bundle length. The length is more preferably from 200 mm to 300 mm. When the length is 300 mm or shorter, having a large-size apparatus and investment for facilities can be easily avoided.

FIG. 2 is a drawing illustrating an overlapping state of two ends when ends of two carbon fiber precursor acrylic fiber bundles of the present invention are connected to each other. By overlapping part X in which fiber density of precursor fiber bundle 1 at one side is 1.33 g/cm$^3$ or higher with part X' in which fiber density of precursor fiber bundle 1' at other side is 1.33 g/cm$^3$ or higher, two precursor fiber bundles are connected to each other. In the example, each of the part X and part X' corresponds to an end of the precursor fiber bundle. With regard to the connection, it is not necessary that the fiber density of an end of a precursor fiber bundle is 1.33 g/cm$^3$ or higher. Instead, it is sufficient that the part X and part X' are overlapped and connected to each other. In other words, it is possible that the precursor fiber bundle contains a part having fiber density of lower than 1.33 g/cm$^3$ in a more distant end side than the part X. Further, although the precursor fiber bundles are directly connected to each other in this example, it is also possible that two precursor fiber bundles are indirectly connected to each other via other fiber bundle which has high fiber density of 1.33 g/cm$^3$ or higher in its entirety.

<Thermal Oxidation Oven>

Next, explanations are given with regard to the thermal oxidation oven of the present invention. The thermal oxidation oven has at least one opening and a high temperature heating part and at least one low temperature heating part at a position corresponding to the longitudinal direction of the carbon fiber precursor acrylic fiber bundle to be heated, in which at least one of the low temperature heating part is arranged near the opening.

FIG. 3 is a schematic perspective view of a thermal oxidation oven suitable for producing the precursor fiber bundle of the present invention. The thermal oxidation oven consists of thermal oxidation oven top part 3 and thermal oxidation oven bottom part 4. The backside of the thermal oxidation oven top part and the backside of the thermal oxidation oven bottom part are connected to each other via a hinge part (not illustrated), and opening and closing can be made with an aid of the hinge part. For the safety during opening and closing, a wire for limiting the opening level of the thermal oxidation oven top part and thermal oxidation oven bottom part is installed (not illustrated). Meanwhile, the figure represents a state in which the top part of the thermal oxidation oven is open at 90 degrees.

It is also possible that the thermal oxidation oven can be moved back and forth by having a moving means like wheel on a base part (not illustrated). When the precursor fiber bundle is horizontally placed and the thermal oxidation oven is moved forward after opening the top part of the thermal oxidation oven, the precursor fiber bundle can be introduced to an inside of the furnace. By closing the top part of the thermal oxidation oven after the introduction, the thermal oxidation of the precursor fiber bundle can be safely performed.

The high temperature heating part of the thermal oxidation oven is formed of structural materials such as iron or stainless.

In the examples of FIG. 3, openings 5 and 5' are formed for placing the precursor fiber bundle. The thermal oxidation oven has a low temperature heating part on an inner side of the furnace of at least one of the openings 5 and 5'. It also has a high temperature heating part on the inner side. In the figure, the wind-blocking plates 2 and 2' for forming the low temperature heating part are arranged, on an inner side of the furnace of each opening, in upward and downward regions from the position at which the precursor fiber bundle is placed. It is also equipped with a hot wind circulator which is not illustrated. The hot wind circulator is provided with a heater, a fan, a temperature detector, a device for controlling temperature/fan rotation speed, and the like, and thus the wind rate and temperature of hot wind circulating in the furnace can be arbitrarily set. In the thermal oxidation oven, a part in which hot wind is blocked by a wind-blocking plate is a low temperature heating part and a part in which hot wind is directly applied is a high temperature heating part.

The low temperature heating part and the high temperature heating part can be also achieved by, without being limited by the aforementioned method, enabling control of internal temperature of a thermal oxidation oven for individual regions, for example. It can be achieved by a means including disposing plural heaters, varying volume of hot wind for individual regions, applying a suitable amount of external air to a low temperature heating part, or the like, for example.

In case of using a wind-blocking plate, the length of the wind-blocking plate is preferably 50 mm to 300 mm, considering the length of the part Y between an intermediate density point and a maximum density region arrival point and also the size of a thermal oxidation oven. It is more preferably 100 mm to 250 mm. Accordingly, the low temperature heating part can be conveniently formed.

FIG. 4 is a schematic cross-sectional view of the thermal oxidation oven, briefly illustrating wind flow. The thermal oxidation treatment is performed in a gas atmosphere containing oxygen gas. In general, it is in an air atmosphere. Hot wind within the furnace is heated by a hot wind circulator and induced from a bottom internal space of a thermal oxidation oven to a top space of the thermal oxidation oven via the backside. The hot wind induced to the top space of the thermal oxidation oven passes through a stationing device such as honeycomb or porous plate (not illustrated) and flows from the top to the bottom of the precursor fiber bundle. Because the wind-blocking plates 2 and 2' are arranged on the inner side of the furnace of the openings 5 and 5', hot wind is not in direct contact with the precursor fiber bundle near the openings. For such reasons, the inner sides of the furnace of the openings 5 and 5' become low temperature heating parts.

Together with gas generated from the precursor fiber bundle, the hot wind after heating the precursor fiber bundle directly reaches the internal bottom space of the thermal oxidation oven. Part of the hot wind and generated gas are transferred from the internal bottom space of the thermal oxidation oven to a discharge system. By suctioning via the openings 5 and 5' fresh air in an amount corresponding to the hot wind discharged to an outside of the furnace, not only the temperature of the low temperature heating part can be lowered but also the discharge of the gas, which is generated from the precursor fiber bundle, from the opening to an outside of the furnace can be prevented.

<Method for Thermal Oxidation Treatment>

Next, explanations are given for a method for thermal oxidation treatment using the thermal oxidation oven.

The process for producing a carbon fiber precursor acrylic fiber bundle of the present invention satisfies the following requirements (1) to (4).

[Requirement (1)]

A part of the carbon fiber precursor acrylic fiber bundle is arranged inside a thermal oxidation oven having at least one opening and the remaining part of the carbon fiber precursor acrylic fiber bundle is arranged outside the thermal oxidation oven.

The method for disposing the precursor fiber bundle within the thermal oxidation oven is not limited. However, it can be performed as described below, for example. By using a means for holding a fiber bundle having a fixing part and a load application part (not illustrated), the end of the precursor fiber bundle is arranged horizontally such that the distance Lw between the fixing part and the load application part is longer than the furnace length Lo of a thermal oxidation oven (FIG. 3). In the same state, the thermal oxidation oven is moved forward and the precursor fiber bundle is arranged on positions corresponding to the openings 5 and 5' followed by application of a load like pendulum on a load application part. Alternatively, the precursor fiber bundle is introduced from the opening 5 to the inside of the thermal oxidation oven via the means for holding the fiber bundle (not illustrated) and then extracted from the opening 5' to the outside of the furnace via the low temperature heating part at one side, the center part of the thermal oxidation oven, and the low temperature heating part at other side. A load like pendulum is applied to an end of the precursor fiber bundle induced to the outside of the furnace.

[Requirement (2)]

The precursor fiber bundle is heated, at a position corresponding to the longitudinal direction, with hot wind at a high temperature and hot wind at a low temperature, in which the precursor fiber bundle present near at least one opening is heated by the hot wind at a low temperature.

The precursor fiber bundle is subjected to a thermal oxidation treatment according to direct contact with hot wind at a high temperature inside the thermal oxidation oven. Meanwhile, in the low temperature heating part, direct contact between the precursor fiber bundle and hot wind is prevented by the wind-blocking plate and cooling is achieved with external air which is suctioned via the openings 5 and 5', and thus gradual thermal oxidation occurs and also a mild increase in fiber density is obtained. In the precursor fiber bundle obtained after the thermal oxidation treatment, the part positioned at the center of the thermal oxidation oven exhibits the highest fiber density while the fiber density is the lowest in the part positioned near the openings 5 and 5'. In the precursor fiber bundle after completion of the thermal oxidation treatment, the part Z at the load application part has fiber density of lower than 1.33 g/cm$^3$. As such, it is removed by being cut at the boundary with the part X. Accordingly, a precursor fiber bundle having the part X at an end thereof can be obtained.

According to the requirement (2), because the thermal oxidation oven has a means for applying hot wind to a fiber bundle and a wind-blocking plate for blocking the hot wind, in which the low temperature heating part is formed by the wind-blocking plate, the treatment can be performed conveniently.

[Requirement (3)]

Temperature of the hot wind at a high temperature is at least in the temperature range of 200° C. to 300° C., in terms of the maximum temperature from the start to the end of heating.

By performing the thermal oxidation treatment at a temperature within this range, the fiber density of a high density part can be adjusted to 1.33 g/cm$^3$ or higher.

[Requirement (4)]

Heating is performed until the maximum fiber density of the high density part reaches 1.33 g/cm$^3$ or more.

It is also preferable that the process for producing a carbon fiber precursor acrylic fiber bundle of the present invention satisfy the following requirement (5).

[Requirement (5)]

Heating temperature T is raised to temperature which is lower than the upper limit temperature Tmax of a precursor fiber bundle to be heated at that heating time point by 3 to 5° C.

The temperature of a thermal oxidation oven can be set as described below, for example.

FIG. 5 is a drawing illustrating an exemplary over-the-time change of the "upper limit temperature Tmax for thermal oxidation treatment", heating temperature T, and expected density in order to obtain the precursor fiber bundle of the present invention. In the drawing, an example in which the upper limit temperature Tmax of the precursor fiber bundle as a subject for the thermal oxidation treatment is 241° C. is shown. The temperature for heating the thermal oxidation oven which enables a safe thermal oxidation treatment is 236° C., which is lower by 5° C. than the upper limit temperature Tmax, considering the temperature distribution inside the furnace, or the like. When the thermal oxidation treatment is initiated with the initial heating temperature Ti of 236° C., the precursor fiber bundle undergoes a thermal oxidation treatment over the time and the fiber density increases. Since the upper limit temperature Tmax of the precursor fiber bundle also increases in accordance with the increase in fiber density, the heating temperature T can be raised in response to such temperature increase. Thus, by raising the heating temperature every minute, for example, the thermal oxidation treatment for having target fiber density can be performed within the shortest time. It is preferable that the initial heating temperature Ti and the following heating temperature T be set at temperature which is 3 to 5° C. lower than "the upper limit temperature Tmax for thermal oxidation treatment". The heating temperature T can be raised whenever the heating time lapses. Considering a connection between the previous and following steps, the heating temperature T before reaching the fiber density of 1.33 g/cm$^3$ may be continuously raised or raised in a stepwise manner at certain time point, within a range in which it is 3 to 5° C. lower than the upper limit temperature Tmax.

The thermal oxidation oven and thermal oxidation treatment method of the present invention are not limited to the thermal oxidation oven and thermal oxidation treatment method described above as long as they allow production of a precursor fiber bundle. A thermal oxidation oven or a thermal oxidation treatment method with suitably modified various requirements can be also used.

<Process for Producing Carbon Fiber Bundle>

The process for producing a carbon fiber bundle of the present invention is a method having the following Step (1) to Step (3);

(1) Step for connecting an end of a high density part of a precursor fiber bundle, which has a high density part at an end thereof (a portion with length L), to an end of a high density part of another identical precursor fiber bundle, which has a high density part at an end thereof (a portion with length L).

(2) Step for performing a flame resistance treatment by heating the connected precursor fiber bundle in an oxidizing atmosphere of the temperature range of 200 to 300° C., and (3) Step for performing a carbonization treatment by heating the obtained flame resistant fiber bundle in an inert atmosphere and in the temperature range of 1000° C. or higher.

According to this method, it can smoothly pass through both the flame resistance impartation step and carbonization step.

A connection part between a series of the carbon fiber precursor acrylic fiber bundle of the present invention, that is, a connection part in which the high density parts are subjected for an entanglement treatment for integration, can be formed by the following method (1) or method (2) after having an overlap of the portion with length L in the high density part.

(1) Fiber yarns in overlapped part are entangled with each other by a high speed fluid treatment using air or the like for integration.

(2) Fiber yarns in overlapped part are entangled with each other by using a needle punch for integration.

With the method (2), a part of the fiber yarn forming the high density part may be broken and a long time is required for integration by an entanglement treatment. As such, the method (1) is preferred over the method (2).

When the end of each precursor fiber bundle is cut near the end of the density increase start point, to which the pendulum is applied, before performing an entanglement treatment for connecting the high density part, it becomes easier to handle the precursor fiber bundle during an entanglement treatment, and therefore desirable.

When high pressure fluid is sprayed from a nozzle, the spray pressure is preferably 0.5 to 1.0 MPa. When the spray pressure is less than 0.5 MPa, it cannot withstand the process tension of the carbonization step during which carbonization is performed at high speed. On the other hand, when the pressure is more than 1.0 MPa, a part of the fiber bundle forming the high density part may be broken, and therefore undesirable.

When there are three or more positions at which the fiber bundle in overlapped region is subjected to an entanglement treatment for integration, the connection part of the precursor fiber bundle can withstand the process tension of the carbonization step during which carbonization is performed at high speed. Furthermore, when there are seven or more positions for entanglement, efforts are needed for connection due to a large-size device for connection. Thus, the entanglement positions are preferably 6 or less. When there are five or less entanglement positions, for example, a nozzle for spraying high pressure fluid is arranged at five positions of X1, X2, X3, X4, and X5 in FIG. 2. Because the position in the length direction of X1 is closer to the part Y (in direction to left in FIG. 2) than the tip part of the part X (right end of X in FIG. 2), the tip part of the part X is not subjected to an entanglement treatment. Although it may vary depending on conditions for an entanglement treatment, the length of the fiber bundle for an entanglement treatment is around 150 to 400 mm, for example. The length of the tip part of the fiber bundle which does not undergo an entanglement treatment (a portion with length Lt) is around 250 to 600 mm, for example.

With regard to the connection part, it is preferable to cut and remove the tip part of a fiber bundle which has not been subjected to an entanglement treatment. With such treatment, the property of passing through the steps of the fiber bundle against the flame resistance impartation step, pre-carbonization step, and carbonization step can be improved.

Further, when a tip part of the fiber bundle is cut and removed, it is preferable to have a cut while keeping 0.2 cm to 0.8 cm of the non-entangled part and embed the remaining tip part of the fiber bundle in the connection part of the precursor fiber bundle by the aforementioned high speed fluid treatment. According to this embedding treatment (hereinbelow, it may be also referred to as an "end treatment"), winding of a fiber bundle to a roller, which occurs due to the tip part of the fiber bundle, can be prevented, and also the jamming of the tip part of the fiber bundle in the guide can be prevented.

EXAMPLES

Hereinbelow, the present invention is explained in view of the examples.

Example 1

Eight boxes each added with a precursor fiber a bundle having fiber density of 1.18 g/cm$^3$, monofilament denier of 1.0 dtex/filament, a filament number of 60000, and a length of 50 m were prepared. The upper limit temperature Tmax for thermal oxidation treatment of the precursor fiber bundle was 250° C. Further, a thermal oxidation oven (a length of 1400 mm, an inner length of 900 mm, and a height of 1400 mm) having an opening with the structure shown in FIG. 3 was prepared. The opening has a length of 150 mm, an inner length of 320 mm and a height of 20 mm, and each of the four wind-blocking plates has a size in which height is 150 mm and an inner length is 450 mm.

Two ends were released from each precursor fiber bundle in four boxes and the precursor fiber bundle and the thermal oxidation oven were arranged to be in a state shown in FIG. 3. Subsequently, the thermal oxidation oven was moved and the precursor fiber bundle was arranged at the center of the opening portion of the thermal oxidation oven as shown in FIG. 4. To the end of the precursor fiber bundle outside the furnace, a pendulum was added to apply tension of 6.5 N per 10000 dtex of the precursor fiber bundle. In an air atmosphere, a thermal oxidation treatment was initiated in a still state while the initial heating temperature Ti of the thermal oxidation oven was set at 245° C. To maintain "Tmax−T≤5° C.", the heating temperature T was raised and the heating temperature was eventually raised to 273° C. so that the thermal oxidation treatment was performed for 70 minutes in total.

The same operations as above were performed for the remaining four boxes to have a thermal oxidation treatment performed for each of the two ends of the precursor fiber bundle in the eight boxes.

Fiber density was measured according to the following method for one end of the precursor fiber bundle in the eight boxes which has been thus obtained from the above. The density measurement point was a position located at intervals of 50 mm between the −150 mm position (first measurement point), which is in the outside direction of a thermal oxidation oven from the reference point (0 mm) of a thermal oxidation oven, and the 550 mm position (fifteenth measurement point), which is in the direction toward the center of the furnace. The fiber bundle having the length of 40 mm around each density measurement point as selected above was cut and used as a test specimen. Measurement of the fiber density was performed according to JIS R7603: 1999 Carbon fiber—Method for determination of density (Method C: Density gradient tube method). Meanwhile, the aforementioned "−150 mm" position corresponds to the outermost portion of the thermal oxidation oven.

The maximum fiber density $\rho_{max}$ of the precursor fiber bundle was 1.42 g/cm$^3$ and the position within the furnace and change curve of the fiber density were similar to those of "line b" in FIG. 1. Lengths of the part X, part Y, and a length Z were as follows: X: 600 mm; Y: 85 mm; and Z: 250 mm, respectively. The maximum value of an increase in the fiber density per 10 mm of the fiber bundle length between the intermediate density point and the maximum density region arrival point (that is, a portion of part Y) was $0.67\times10^{-2}$ g/cm$^3$.

Each precursor fiber bundle was cut near the density increase start point at the end to which a pendulum has been added, and thus eight precursor fiber bundles having a high density part at both ends thereof were obtained.

By using the eight boxes of a precursor fiber bundle which have been obtained from above, the high density part at a front side of each precursor fiber bundle and the high density part of the adding source distal end in other box were overlapped with each other such that the tips of ends were in an opposite direction. After that, the fiber bundle in the overlapped region was subjected to a 5-point entanglement treatment based on a high speed fluid treatment. Accordingly, it was integrated to form a connection part. The Lt of the high density part, which has not been subjected to an entanglement treatment, from the entanglement treatment part to the tip part of the fiber bundle, was 350 mm. Air was used as high speed fluid and the pressure for the treatment was 0.5 MPa.

After that, the fiber bundle was cut so as to keep a portion with a length of 0.8 mm in the high density part which has not been subjected to an entanglement treatment. Subsequently, the portion which has not been subjected to an entanglement treatment was subjected to an end treatment for embedding it in the connection part of the precursor fiber bundle according to a high speed fluid treatment. Accordingly, eight precursor fiber bundles were connected to each other.

Thus-connected precursor fiber bundle was continuously supplied to a furnace for flame resistance treatment having circulating hot wind at 227 to 248° C. for a flame resistance treatment for 60 minutes at tension of 24.5 mN/tex. Subsequently, the fiber bundle after flame resistance treatment was continuously supplied from a furnace for pre-carbonization to a furnace for carbonization to obtain a carbonized fiber bundle. With regard to the furnace for pre-carbonization, the fiber bundle obtained after flame resistance treatment was subjected to a pre-carbonization treatment for 1.5 minutes in a nitrogen atmosphere at 300 to 600° C. With regard to the elongation rate for fiber bundle, the initial elongation rate was 3% and it was increased by 1% whenever the connection part passes through the furnace for pre-carbonization, thus having the final elongation rate of 9%. During the pre-carbonization step, the property of passing through the step was determined for each connection part having a varying elongation rate. As a result, it was found that the fiber bundle is not broken even when the elongation rate for pre-carbonization is as high as 9%.

With regard to a furnace for carbonization, the fiber bundle obtained after the pre-carbonization treatment was subjected to a carbonization treatment in a nitrogen atmosphere having temperature distribution of 1150 to 1250° C. while the elongation rate for fiber bundle is set at −4.5%. Even after the carbonization treatment, there was no breaking of the fiber bundle and it was possible to perform the carbonization treatment without any problem.

Example 2

A precursor fiber bundle having monofilament denier of 1.39 dtex/filament, filament number of 50000, and upper limit temperature Tmax for thermal oxidation treatment of 241° C. was prepared. Further, the initial heating temperature Ti was set at 236° C. A thermal oxidation treatment was then performed such that other conditions are the same as those of Example 1.

Thus-obtained fiber bundle was cut to obtain a precursor fiber bundle in which the part X, part Y, and part Z have lengths of 600 mm, 150 mm, and 250 mm, respectively. The maximum fiber density $\rho_{max}$ of the portion subjected to a thermal oxidation treatment was 1.42 g/cm$^3$ and the maximum value of an increase in the fiber density per 10 mm of the fiber bundle length between the intermediate density point and the maximum density region arrival point (that is, a portion of part Y) was $1.01\times10^{-2}$ g/cm$^3$.

Subsequently, the entanglement treatment, end treatment, flame resistance treatment, pre-carbonization treatment, and carbonization treatment were performed in the same manner as Example 1 by using high speed fluid and the property of passing through the step was determined. The fiber bundle was not broken even when an elongation was made with the elongation rate as high as 9% during the pre-carbonization step, and the carbonization treatment can be performed without any problem.

Example 3

A thermal oxidation treatment was performed in the same manner as Example 1 except that a precursor fiber bundle having monofilament denier of 1.39 dtex/filament, filament number of 50000, and upper limit temperature Tmax for thermal oxidation treatment of 241° C. was used and the heating temperature is a constant temperature of 236° C. It took 180 minutes until that the maximum fiber density $\rho_{max}$ of the end of the fiber bundle increases to 1.42 g/cm$^3$. The maximum value of an increase in the fiber density per 10 mm of the fiber bundle length between the intermediate density point and the maximum density region arrival point (that is, a portion of part Y) was $1.01\times10^{-2}$ g/cm$^3$.

Subsequently, the entanglement treatment, end treatment, flame resistance treatment, pre-carbonization treatment, and carbonization treatment were performed in the same manner as Example 1 by using high speed fluid and the property of passing through the step was determined. The fiber bundle was not broken even when an elongation was made with the elongation rate as high as 9% during the pre-carbonization step, and the carbonization treatment can be performed without any problem.

Example 4

A thermal oxidation treatment was performed in the same manner as Example 1 except that the time for thermal oxidation treatment was 50 minutes to lower the maximum fiber density to 1.36 g/cm$^3$. The maximum value of an increase in the fiber density per 10 mm of the fiber bundle in the longitudinal direction between the intermediate density point and the maximum density region arrival point (that is, a portion of part Y) was $1.06\times10^{-2}$ g/cm$^3$.

Subsequently, the entanglement treatment, end treatment, flame resistance treatment, pre-carbonization treatment, and carbonization treatment were performed in the same manner as Example 1 by using high speed fluid and the property of passing through the step was determined. The fiber bundle was not broken even when an elongation was made with the elongation rate as high as 3% during the pre-carbonization step. However, when the elongation of 4% was made, the fiber bundle was broken.

Comparative Example 1

A thermal oxidation treatment was performed for 50 minutes at heating temperature of 245° C. by using the same precursor fiber bundle as Example 1 while applying tension of 39 N and without installing a wind-blocking plate. The maximum fiber density $\rho_{max}$ of the thermal oxidation treatment part of thus obtained precursor fiber bundle was 1.36 g/cm$^3$. The maximum value of an increase in the fiber density per 10 mm of the fiber bundle length between the intermediate density point and the maximum density region arrival point was $2.25\times10^{-2}$ g/cm$^3$. Further, the increase in the fiber density per 10 mm of the fiber bundle length was $2.0\times10^{-2}$ g/cm$^3$ between the density increase start point and the intermediate density point.

length between the intermediate density point and the maximum density region arrival point (a portion of part Y). With regard to the "temperature increase for heating", when the thermal oxidation treatment is performed while increasing the heating temperature T of a thermal oxidation oven such that it can maintain "Tmax−T≤5° C.", it is described as "yes". On the other hand, when the thermal oxidation treatment is performed at constant temperature (an initial heating temperature of Ti) without increasing the heating temperature, it is described as "no."

TABLE 1

| | Denier (dtex) | Filament number | Wind-blocking plate | Temperature increase for heating | Maximum fiber density (g/cm$^3$) | Time for thermal oxidation treatment (minutes) | Increase amount of fiber density per 10 mm of a fiber bundle length in part Y (g/cm$^3$) | Elongation rate by pre-carbonization treatment (%) |
|---|---|---|---|---|---|---|---|---|
| Example 1 | 1.00 | 60000 | yes | yes | 1.42 | 70 | $0.67 \times 10^{-2}$ | 9 |
| Example 2 | 1.39 | 50000 | yes | yes | 1.42 | 70 | $1.01 \times 10^{-2}$ | 9 |
| Example 3 | 1.39 | 50000 | yes | no | 1.42 | 180 | $1.01 \times 10^{-2}$ | 9 |
| Example 4 | 1.00 | 60000 | yes | no | 1.36 | 50 | $1.06 \times 10^{-3}$ | 3 |
| Comparative Example 1 | 1.00 | 60000 | no | no | 1.36 | 50 | $2.25 \times 10^{-2}$ | — |
| Comparative Example 2 | 1.00 | 60000 | no | no | 1.42 | 120 | $1.63 \times 10^{-2}$ | — |

Symbol [—]: fiber bundle did not pass through the step.

Subsequently, the entanglement treatment, end treatment, flame resistance treatment, and pre-carbonization treatment were performed in the same manner as Example 1 by using high speed fluid and the property of passing through the step was determined. The fiber bundle was broken even when the elongation rate for pre-carbonization was 3%, and thus it was impossible to perform a carbonization treatment.

Comparative Example 2

The precursor fiber bundle having an end subjected to thermal oxidation treatment was obtained in the same manner as Example 1 except that a wind-blocking plate was not installed and the condition for the thermal oxidation treatment includes heating for 120 minutes at temperature of 245° C. The maximum fiber density $\rho_{max}$ of the thermal oxidation treatment part of the end of the fiber bundle was 1.42 g/cm$^3$. The maximum value of an increase in the fiber density per 10 mm of the fiber bundle length between the intermediate density point and the maximum density region arrival point was $1.63\times10^{-2}$ g/cm$^3$.

Subsequently, the entanglement treatment, end treatment, and flame resistance treatment were performed in the same manner as Example 1 by using high speed fluid. Then, the pre-carbonization treatment was initiated with an elongation rate of 3% and the property of passing through the step was determined. As a result, the fiber bundle was broken even when the elongation rate for pre-carbonization was 3%, and thus it was impossible to perform a carbonization treatment. The breaking point was in front of the connection part, near the region in which the fiber density was between 1.35 g/cm$^3$ and 1.42 g/cm$^3$.

The elongation rate for the pre-carbonization treatment is as described in Table 1. Meanwhile, the expression "increase amount of fiber density per 10 mm of a fiber bundle length in part Y (g/cm$^3$)" indicates the maximum value of an increase in the fiber density per 10 mm of the fiber bundle

INDUSTRIAL APPLICABILITY

The carbon fiber bundle produced with the precursor fiber bundle of the present invention can be used for industrial applications including an airplane, a sports gear, civil engineering, and an energy-related industry.

EXPLANATIONS OF LETTERS OR NUMERALS

X, X: portion with fiber density of 1.33 g/cm$^3$ or higher (connection part)
Y, Y': portion between the intermediate density point to the maximum density
region arrival point
Z, Z': portion between the density increase start point and the maximum density
region arrival point
Lt: tip part which has not been subjected to an entanglement treatment
1, 1': precursor fiber bundle
2: wind-blocking plate (top)
2': wind-blocking plate (bottom)
3: upper part of thermal oxidation oven
4: lower part of thermal oxidation oven
5, 5': opening
a: density distribution model in which the present invention is not employed
b: density distribution model in which the present invention is employed
c: target fiber density
d: fiber density
e: upper limit temperature
f: set temperature

The invention claimed is:

1. A carbon fiber precursor acrylic fiber bundle comprising a plurality of high density parts as a portion thereof, wherein each high density part has a preceding density increase start point and a trailing density increase start point, wherein the high density parts satisfy requirements A and B:

A: the high density parts have a maximum fiber density $\rho_{max}$ of 1.33 g/cm$^3$ or higher, and B: an increase in fiber density between an intermediate density point and a maximum density region arrival point is $1.3\times10^{-2}$ g/cm$^3$ or less per 10 mm of a fiber bundle length;

with the proviso that, the term "intermediate density point" is defined as the site which has a density $\rho_m$ ($=(\rho_0+\rho_{max})/2$) that is intermediate between the fiber density $\rho_0$ of a non-high density part and the maximum fiber density $\rho_{max}$, the term "maximum density region arrival point" is defined as the site $P_r$ at which the increase in fiber density per 10 mm of the fiber bundle length becomes $1.0\times10^{-3}$ g/cm$^3$ or less, the increase in fiber density being represented by $(\rho_{r+1}-\rho_r)/5$ determined from a measurement in which density measurement points beginning with the density increase start point and located at intervals of 50 mm ($P_1$, $P_2$, . . . , $P_r$, $P_{r+1}$, . . . , $P_n$) are successively examined for fiber density ($\rho_1$, $\rho_2$, . . . , $\rho_r$, . . . , $\rho_n$), and the term "density increase start point" is defined as a site at which the fiber density is higher by 0.01 g/cm$^3$ than the fiber density $\rho_0$ of the non-high density part.

2. The carbon fiber precursor acrylic fiber bundle according to claim 1, wherein the high density parts further satisfy requirement C:

C: the fiber density monotonously increases from the preceding density increase start point to the maximum density region arrival point.

3. The carbon fiber precursor acrylic fiber bundle according to claim 1, wherein the high density parts further satisfy requirement D:

D: the increase in fiber density per 10 mm of the fiber bundle length is $2.0\times10^{-2}$ g/cm$^3$ or less from the density increase start points to the intermediate density points.

4. The carbon fiber precursor acrylic fiber bundle according to claim 1, wherein the high density parts further satisfy requirement E:

E: a length of the part in which the fiber density is 1.33 g/cm$^3$ or higher is 50 mm or longer.

5. The carbon fiber precursor acrylic fiber bundle according to claim 1, wherein the high density parts further satisfy requirement F:

F: a length from the density increase start points to the maximum density region arrival points is 150 mm or longer.

6. The carbon fiber precursor acrylic fiber bundle according to claim 1 obtained by (1) arranging a part of a carbon fiber precursor acrylic fiber bundle inside a thermal oxidation oven having at least one opening and arranging the remaining part of the carbon fiber precursor acrylic fiber bundle outside the thermal oxidation oven, (2) heating the part of the carbon fiber precursor acrylic fiber bundle arranged inside the thermal oxidation oven at a position corresponding to the longitudinal direction thereof, with hot wind at a high temperature and hot wind at a low temperature, in which part of the carbon fiber precursor acrylic fiber bundle present near at least one opening is heated by the hot wind at a low temperature, wherein for the temperature of the hot wind at a high temperature, the maximum temperature from the start to the end of heating is in the temperature range of 200° C. to 300° C., and the heating is performed until the maximum fiber density $\rho_{max}$ of the high density parts of the carbon fiber precursor acrylic fiber bundle reaches 1.33 g/cm$^3$ or higher.

7. The carbon fiber precursor acrylic fiber bundle according to claim 1, wherein the high density parts have a maximum fiber density $\rho_{max}$ of 1.36 g/cm$^3$ or higher.

8. The carbon fiber precursor acrylic fiber bundle according to claim 1, wherein the high density parts have a maximum fiber density $\rho_{max}$ of from 1.33 g/cm$^3$ to 1.42 g/cm$^3$.

9. The carbon fiber precursor acrylic fiber bundle according to claim 1, wherein the non-high density parts have a fiber density of from 1.18 g/cm$^3$ to less than 1.33 g/cm$^3$.

10. The carbon fiber precursor acrylic fiber bundle according to claim 1, wherein the high density parts comprise a plurality of entangled end-cut fibers.

11. The carbon fiber precursor acrylic fiber bundle according to claim 10, wherein the length of entanglement of end-cut fibers is from 150 to 400 mm.

12. A boxed precursor acrylic fiber bundle comprising the carbon fiber precursor acrylic fiber bundle according to claim 1, wherein the carbon fiber precursor acrylic fiber bundle has a first end, a second end and a length, wherein at least the length of the carbon fiber precursor acrylic fiber bundle is in a box.

13. A method for producing the carbon fiber precursor acrylic fiber bundle according to claim 1, the method comprising (1): arranging a part of a carbon fiber precursor acrylic fiber bundle inside a thermal oxidation oven having at least one opening and arranging the remaining part of the carbon fiber precursor acrylic fiber bundle outside the thermal oxidation oven, (2): heating the part of the carbon fiber precursor acrylic fiber bundle arranged inside the thermal oxidation oven at a position corresponding to the longitudinal direction thereof, with hot wind at a high temperature and hot wind at a low temperature, in which part of the carbon fiber precursor acrylic fiber bundle present near at least one opening is heated by the hot wind at a low temperature, wherein for the temperature of the hot wind at a high temperature, the maximum temperature from the start to the end of heating is in a range of from 200° C. to 300° C., and heating is performed until the maximum fiber density $\rho_{max}$ of the high density parts of the carbon fiber precursor acrylic fiber bundle reaches 1.33 g/cm$^3$ or higher.

14. The method according to claim 13, wherein the thermal oxidation oven has a nozzle for spraying hot wind to the carbon fiber precursor acrylic fiber bundle and a wind-blocking plate for blocking the hot wind and hot wind at a low temperature is formed by the wind-blocking plate.

* * * * *